US009901201B2

(12) United States Patent
Shen

(10) Patent No.: US 9,901,201 B2
(45) Date of Patent: Feb. 27, 2018

(54) WATER BOTTLE

(71) Applicant: Li-Shu Shen, Taoyuan (TW)

(72) Inventor: Li-Shu Shen, Taoyuan (TW)

(73) Assignee: Li-Shu Shen, Taoyuan (TW)

( * ) Notice: Subject to any disclaimer, the term of this patent is extended or adjusted under 35 U.S.C. 154(b) by 171 days.

(21) Appl. No.: 14/994,331

(22) Filed: Jan. 13, 2016

(65) Prior Publication Data

US 2017/0196384 A1 Jul. 13, 2017

(51) Int. Cl.

| | |
|---|---|
| ***B65D 45/28*** | (2006.01) |
| ***A47G 19/22*** | (2006.01) |
| ***B65D 51/18*** | (2006.01) |
| ***B65D 51/24*** | (2006.01) |

(52) U.S. Cl.

CPC ..... *A47G 19/2272* (2013.01); *B65D 51/18* (2013.01); *B65D 51/24* (2013.01); *B65D 51/242* (2013.01); *B65D 2251/0018* (2013.01); *B65D 2251/0081* (2013.01)

(58) Field of Classification Search

CPC .... B65D 77/283; B65D 1/023; B65D 50/045; B65D 50/046; B65D 51/18; A47G 21/18

USPC ..... 220/323, 829, 706, 709

See application file for complete search history.

(56) References Cited

U.S. PATENT DOCUMENTS

| | | | | |
|---|---|---|---|---|
| 4,909,437 | A * | 3/1990 | Kang | B65D 77/283 239/33 |
| 5,004,880 | A * | 4/1991 | Koutaka | H01H 13/14 200/308 |
| 2002/0170874 | A1* | 11/2002 | Hou | B65D 1/023 215/40 |

* cited by examiner

*Primary Examiner* — Jeffrey Allen

(74) *Attorney, Agent, or Firm* — Amin, Turocy & Watson LLP

(57) ABSTRACT

A water bottle is provided, including a first cover, a second cover having a convex tube, a push button structure, a bottle body, and a straw structure. The push button structure includes a body, a first buckle member, a second buckle member, and an elastic member. The first buckle member is for buckling the first cover. The second buckle member is for buckling the second cover. The elastic member is for bearing against the second cover. The bottle body is used to be connected with the second cover. The straw structure is located inside the bottle body and the convex tube, and includes an elongate tube and an elastic tube. The elastic forces of the push button structure and the straw structure facilitate the water bottle to be used easily.

17 Claims, 12 Drawing Sheets

WATER BOTTLE

BACKGROUND

1. Technical Field

The disclosure relates to water bottles, and, in particular, to a water bottle having a push button structure and a straw structure that can bounce up and be reset.

2. Description of Related Art

A traditional water bottle mainly comprises a bottle body and a cover. The bottle body has a container and an opening disposed on the top of the bottle body and being in communication with the container. The container is used for containing liquid, such as water or beverage. The bottle body has an external thread disposed on a periphery of the opening. The cover is used to cover the opening. The cover has an internal thread disposed on an inner side thereof that corresponds to the external thread, and can be engaged with the bottle body, such that the liquid contained in the container of the bottle body is prevented from leakage.

In order to facilitate the use of the water bottle, the cover generally will be further divided into two portions, including an upper cover and a lower cover. The lower cover is provided with the internal thread, and has a convex tube that is outward protruded and in communication with the container of the bottle body. The convex tube allows a user to suck the liquid in the bottle body or pour the liquid from the bottle body. The upper cover is used to cover the convex tube. The convex tube is generally designed to be a convex nozzle in the shape of a volcano. The lower cover, while in use, is normally fixed to the bottle body, and will be taken off only when more liquid needs to be filled in the bottle body. The upper cover has one end hinged on the lower cover, and the other end buckled on the lower cover through a buckle structure. A user may press the buckle structure and release the upper cover from the lower cover, so as to expose the convex tube. However, the buckle structure is likely loosened due to the vibration of the water bottle or the false touching by the user, and the liquid contained in container of the bottle body will leak therefrom, without being aware by the user.

Besides, the traditional water bottle generally has a straw additional installed. The straw has a bottom end at the bottom of the bottle body, and a head end extending out from the convex tube of the lower cover, for a user to suck the liquid in the water bottle. However, the straw is unlikely to be reset as a user opens the upper cover, and the head end of the straw cannot protrude from the convex tube smoothly. Accordingly, the user may need to make the straw out with his fingers, or adjust the position of the straw by unscrewing the lower cover, which may cause inconvenience to user.

In view of the above mentioned drawbacks, the traditional water bottle needs to be further improved.

SUMMARY

The present disclosure provides a water bottle, which includes a first cover having a first pivot joint and a first buckle joint; a second cover having a second pivot joint pivotally connected with the first pivot joint, a second buckle joint, and a hollow convex tube connected with two surfaces of the second cover; a push button structure configured to connect the first cover with the second cover, the push button structure including: a body having a top portion, a bottom portion opposing the top portion, and an inner lateral portion disposed between the top portion and the bottom portion; a first buckle member disposed at the top portion; a second buckle member disposed at the bottom portion; and an elastic member disposed at the inner lateral portion, wherein the first buckle member is configured to buckle the first cover, the second buckle member is configured to buckle the second cover, and the elastic member is configured to bear against the second cover; a bottle body connected with the second cover; and a straw structure disposed in the bottle body and the hollow convex tube, the straw structure including: an elongate tube having opposing head end and tail end; and an elastic tube having a neck portion, a sleeve joint disposed adjacent the neck portion and having a caliber gradually increased in a direction away from the neck portion, and a bottom portion opposing the sleeve joint and having at least three grooves around an opening thereof that penetrate a tube wall of the bottom portion of the elastic tube, wherein the tail end of the elongate tube is detachably inserted into the sleeve joint and the neck portion.

DETAILED DESCRIPTION OF THE DISCLOSURE

The following specific examples are given to illustrate the implementation of the present disclosure. It will be appreciated by one skilled in the art that variations of these specific details are possible while still achieving the results of the present disclosure. For various embodiment and combinations can be provided according to the present disclosure.

Figure 1:
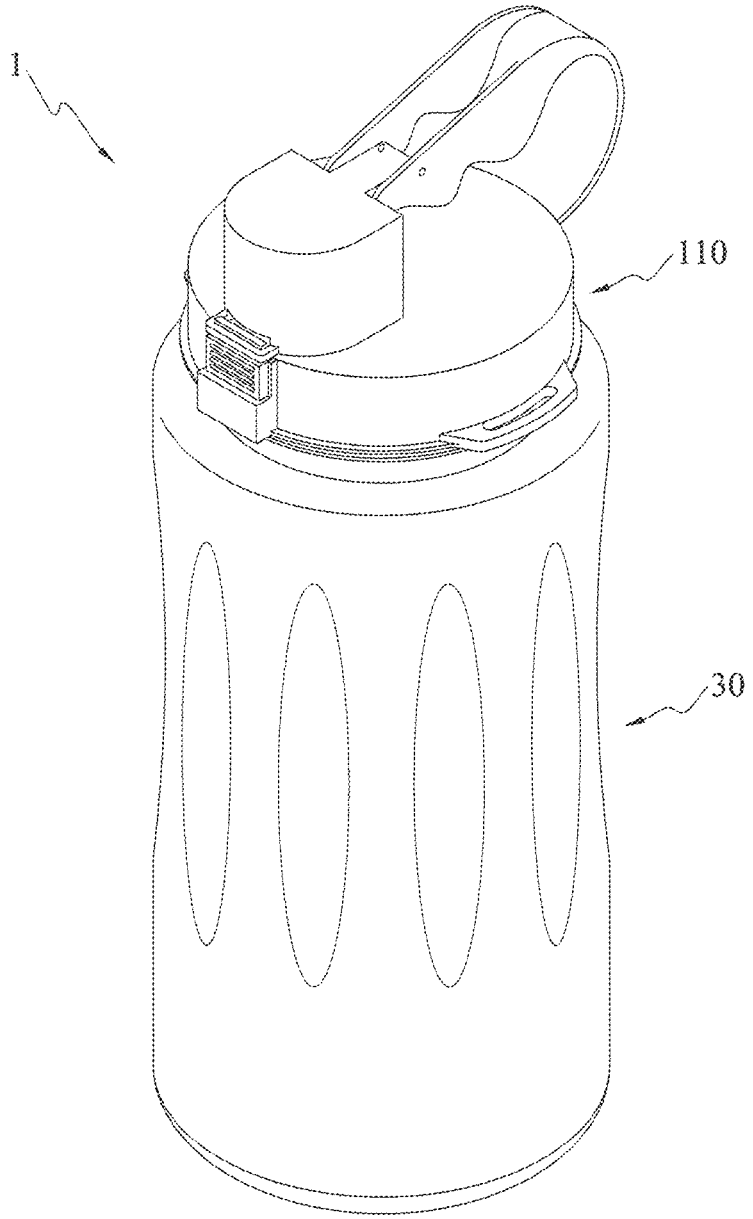
FIG. 1 is a schematic diagram of a water bottle according to the present disclosure.
Figure 2A:
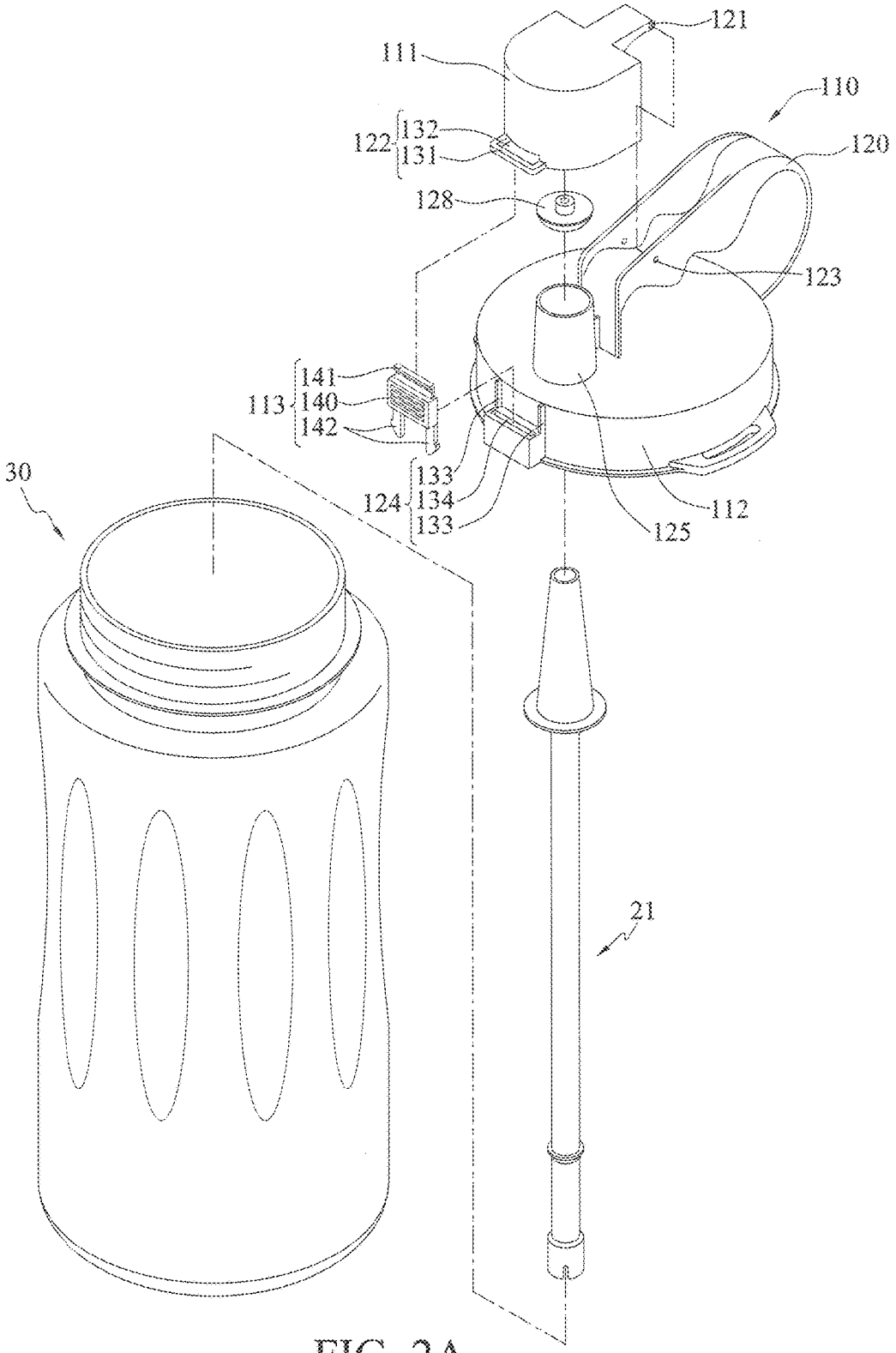
FIG. 2A is an exploded view of the water bottle according to the present disclosure.

As shown in FIGS. 1 and 2A, the water bottle 1 according to the present disclosure includes a cover assembly 110, a straw structure 21 and a bottle body 30. The cover assembly 110 is combined with the bottle body 30 by a thread structure. The straw structure 21 is disposed in the bottle body 30.

The cover assembly 110 includes a first cover 111, a second cover 112, and a push button structure 113. The first cover 111 has a first pivot joint 121 and a first buckle joint 122. The second cover 112 has a second pivot joint 123, a second buckle joint 124, a convex tube 125, and a handle 120. The second pivot joint 123 is disposed on the handle 120 and is pivotally connected with the first pivot joint 121. The first buckle joint 122 and the second buckle joint 124 can be separated or buckled together by the push button structure 113. The first cover 111 can rotate relative to the second cover 112 through the first pivot joint 121 and the second pivot joint 123. The second cover 112 is disposed on the bottle body 30 to cover the opening of the bottle body 30. The convex tube 125 is in communication with the bottle body 30, and the liquid contained in the bottle body 30 can flow out through the convex tube 125, for a user to suck. When a user does not need to use the convex tube 125, the first cover 111 can be used to cover the convex tube 125, and the first buckle joint 122 and the second buckle joint 124 can be buckled together through the push button structure 113, such that the convex tube 125 is sealed, so as to prevent the convex tube 125 from being exposed to contamination and to avoid the liquid from leaking from the bottle body 30 through the convex tube 125. In an embodiment, a sealing pad 128 made of silicone is provided in the first cover 111, and is used to seal the convex tube 125 when the first cover 111 is buckled to the second cover 112.

Figure 2B:
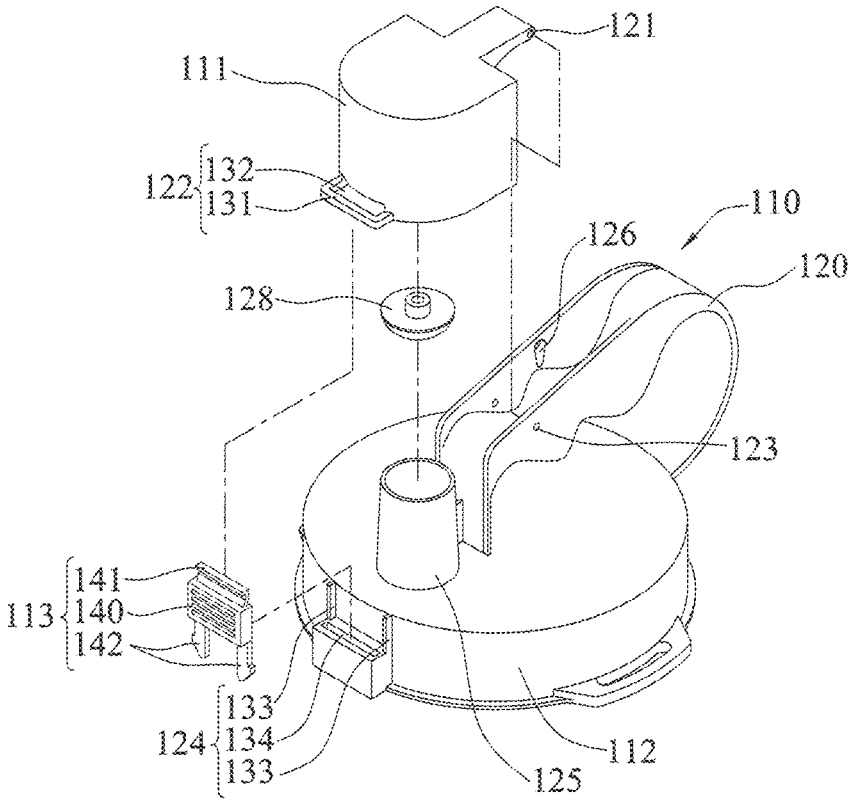
FIG. 2B is an exploded view of a cover assembly of the water bottle according to an embodiment of the present disclosure.

In an embodiment, as shown in FIG. 2B the handle 120 has a first stop portion 126. When the pivot joint 121 of the first cover 111 rotates relative to the second pivot joint 123, the first stop portion 126 is used for buckling the first cover 111 to the second cover 112, thereby fixing the position of the first cover 111, for a user to use the first cover 111 conveniently.

Figure 2C:
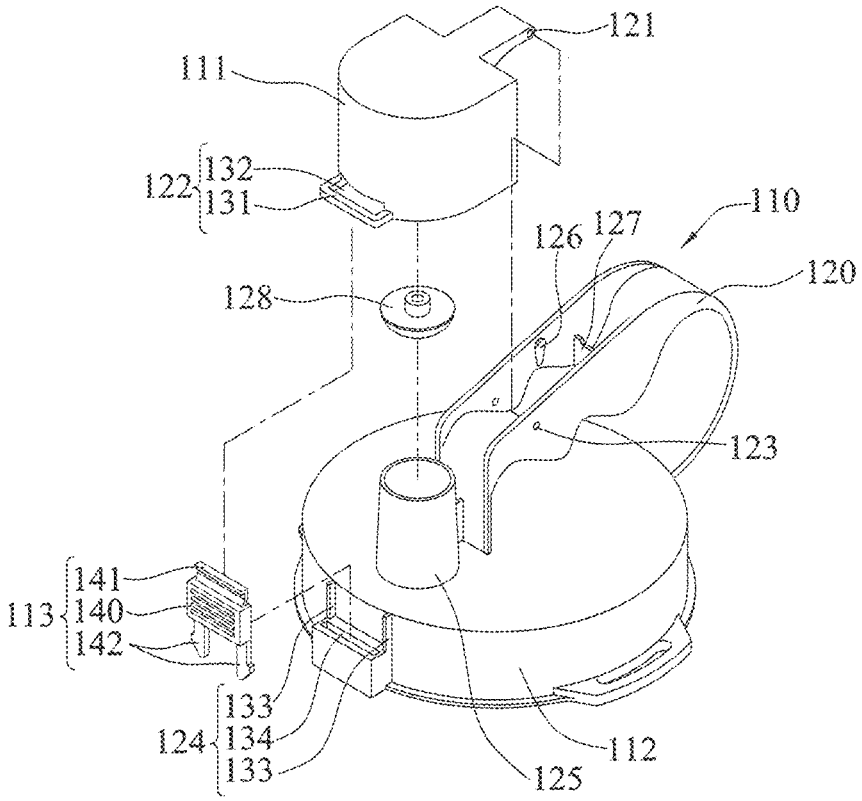
FIG. 2C is an exploded view of a cover assembly of the water bottle according to another embodiment of the present disclosure.

In another embodiment, as shown in FIG. 2C, the handle 120 has a first stop portion 126 and a second stop portion 127. When the pivot joint 121 of the first cover 111 rotates relative to the second pivot joint 121, the first stop portion 126 is used to buckle the first cover 111 to the second cover 112, and the second stop portion 127 is used to provide a stop portion position of the first cover 111, thereby limiting the rotation range of the first cover 111. The first stop portion 126 and the second stop portion 127 can fix the position of the first cover 111 for easy use.

Figure 3:
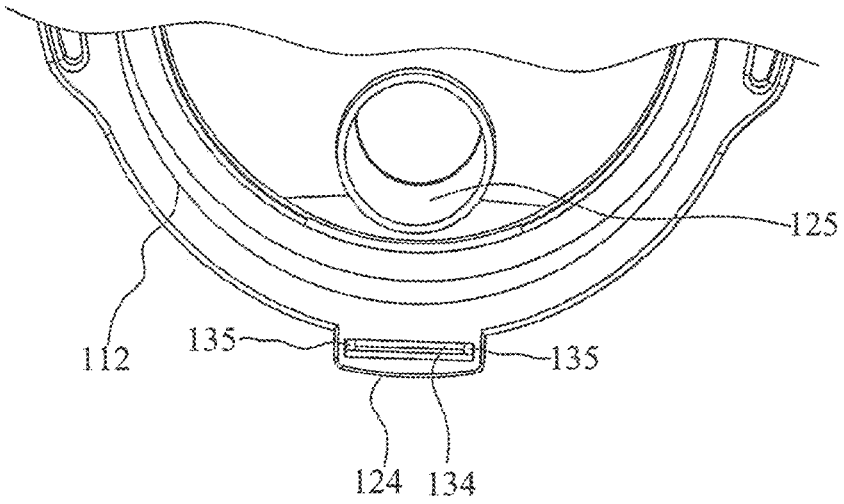
FIG. 3 is a partially bottom view of a second cover according to an embodiment of the present disclosure.

The first buckle joint 122 includes a buckle plate 131 and a buckle groove 132. The buckle plate 131 extends outward from the edge of the first cover 111. The first buckle groove 132 is mounted through the buckle plate 131. Refer to FIG. 3. The second buckle joint 124 includes two opposing limiting walls 133 and a second buckle groove 134 located below the two limiting walls 133. The two side walls inside the second buckle groove 134 are provided with a mismatch 135.

Figure 4A:
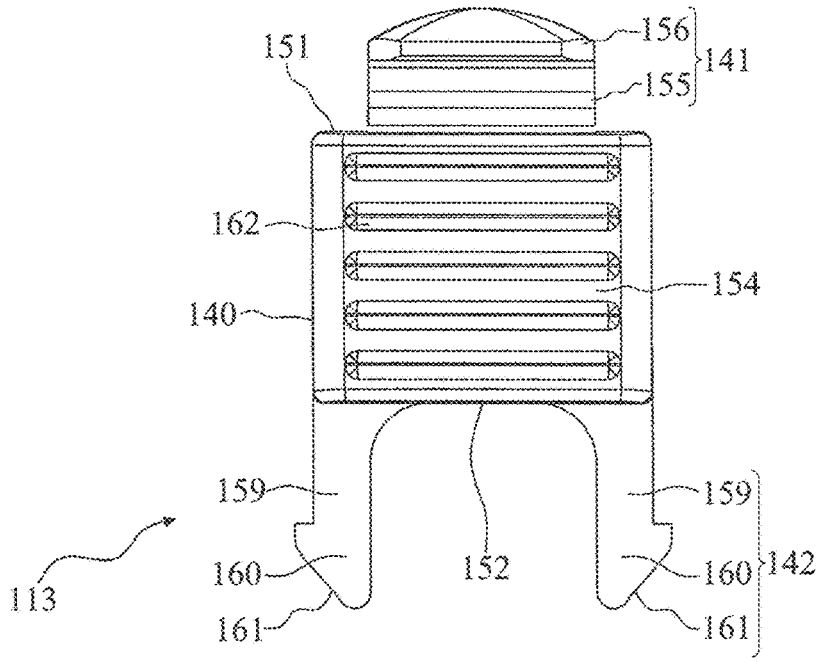
FIG. 4A is a front view of a push button structure according to an embodiment of the present disclosure.
Figure 4B:
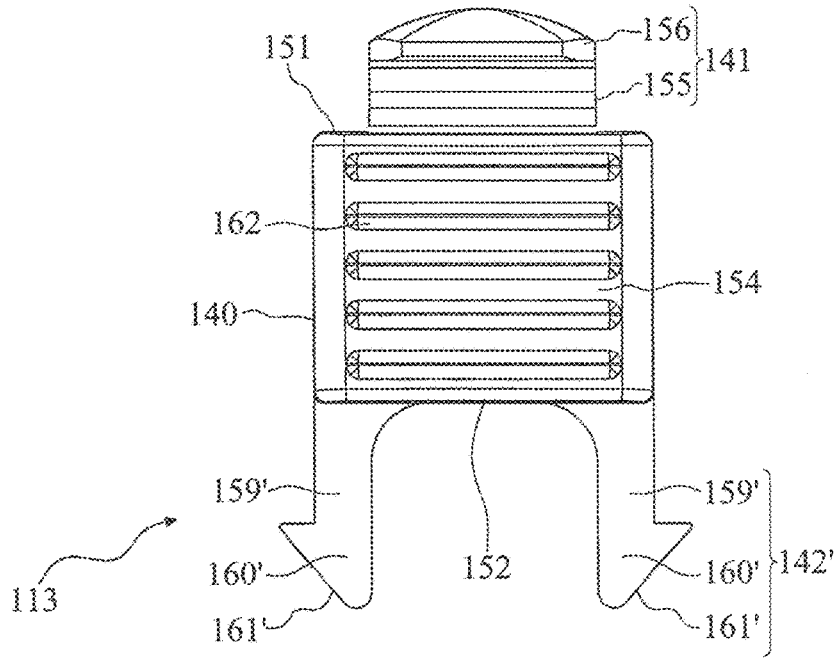
FIG. 4B is a front view of a push button structure according to another embodiment of the present disclosure.
Figure 5:
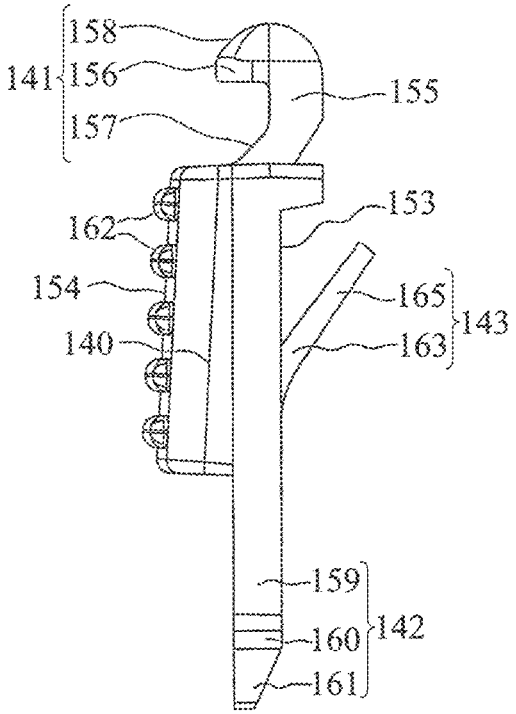
FIG. 5 is a side view of the push button structure according to an embodiment of the present disclosure.

Please refer to FIGS. 2A and 4-6. FIGS. 4-6 are the front view, the side view, and the rear view of the push button structure 113, respectively. The push button structure 113 comprises a body 140, a first buckle member 141, a second buckle member 142, and an elastic member 143. The body 140 has a top portion 151 and a bottom portion 152 opposing the top portion 151, an inner lateral portion 153, and an outer lateral portion 154 opposing the inner lateral portion 153. The inner lateral portion 153 and the outer lateral portion 154 are disposed between the top portion 151 and the bottom portion 152. The first buckle member 141 is located at the top portion 151. The second buckle member 142 is at the bottom portion 152. The elastic member 143 is located on the inner lateral portion 153. The first buckle member 141 is used to buckle the first cover 111. The second buckle member 142 is used to buckle the second cover 112. the elastic member 143 is used to bear against the second cover 112.

The first buckle member 141 includes an elastic arm 155, a cap 156, and a chamfer 157. The elastic arm 155 has one end connected to the top portion 151, and the other end connected to the cap 156. The cap 156 may be assembled with the elastic arm 155 to form a barbed structure. The chamfer 157 is formed between the top portion 151 and the elastic arm 155, and can increase the intensity of the structure. The cap 156 includes an enlarged round 158. The round 158 is formed on the side of the cap 156 back to the elastic arm 155. The second buckle member 142 includes two opposing and symmetric feet 159. The two feet 159 may each include an oblique hook 160. The two oblique hooks 160 are disposed at the ends of the two feet 159 that are distal to the bottom portion 152. The two oblique hooks 160 each have a slope 161 of increasing inclination on the outside surface of the oblique hook 160.

In an embodiment, as shown in FIG. 4A, the slopes 161 of the two oblique hooks 160 slightly protrude out of the two feet 159 to form a hook shape. In another embodiment, as be seen in FIG. 4B, the slopes 161 of the two oblique hooks 160 significantly protrude out of the two feet 159, and the second buckle member 142' buckled with the second cover 122 as shown in FIG. 4B is more stable than the second buckle member 142 as shown in FIG. 4A. Therefore, the structure formed with the slopes 161 of the two oblique hooks 160' is more prominent, and the more stable force can be provided by the second buckle member 142' buckled with the second cover 112.

Figure 6A:
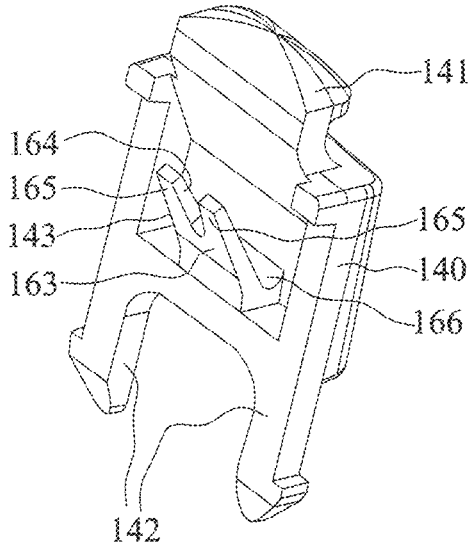
FIG. 6A is a rear view of the push button structure according to an embodiment of the present disclosure.
Figure 6B:
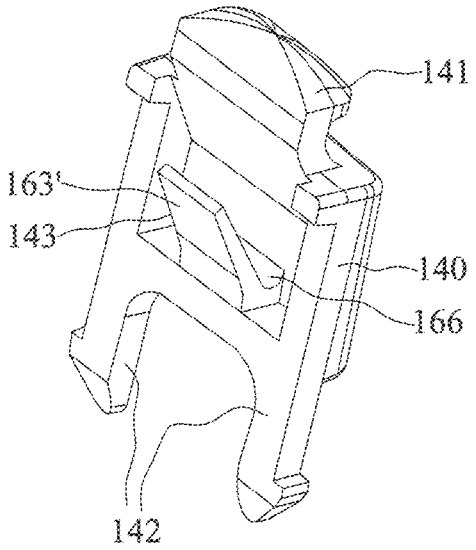
FIG. 6B is a rear view of the push button structure according to another embodiment of the present disclosure.

The outer lateral portion 154 of the body 140 has multiple convex bars 162. The convex bars 162 can increase the friction to enhance the feel. As shown in FIGS. 5, 6A and 6B, the elastic member 143 includes a slant plate 163. The slant plate 163 includes a fixed end and a free end. The fixed end is connected to the inner lateral portion 153. The slant plate 163 extends obliquely relative to the body 140 from the fixed end to the free end. In an embodiment, as seen in FIG. 6A, the slant plate 163 further includes a separation slot 164. The separation slot 164 extends from the free end to the fixed end and extends to the position between the free end and the fixed end. The slant plate 163 is divided into two separate branch plates 165 by the separation slot 164, and the width of the separation slot 164 is gradually decreased from the free end to the fixed end. In other words, the width of the two branch plates 165 is respectively gradually increased from the free end to the fixed end. The elastic member 143 further includes a fillet 166 that is formed between the slant plate 163 and the body 140.

The push button structure 113 is normally assembled to the second cover 112. During assembling, the body 140 is clamped by the two limiting walls 133, and the two feet 159 of the second buckle member 142 are inserted into the second buckle groove 134. When the two feet 159 are inserted into the second buckle groove, it will help to smooth the insertion because of the large angle of inclination of the slope 161, to facilitate assembly. As seen in FIG. 3, when the two feet 159 are inserted into the bottom of the second buckle groove 134, the two oblique hooks 160 will be stuck in the mismatches 135 of the two side walls in the second buckle groove 134, and the push button structure 113 can be fixed on the second cover 112. The elastic member 143 is used to bear against the second cover 112, and the first buckle member 141 of the push button structure 113 and the first buckle joint 122 of the first cover 111 can be buckled together or separated. A user can buckle the first cover 111 to the second cover 112 by covering the convex tube 125 by the first cover 111, such that the buckle plate 131 will be in contact with the first buckle member 141 of the first buckle groove 132, and the cap 156 will penetrate the first buckle groove 132 by exerting a force under pressure. After the cap 156 penetrates the first buckle groove 132, the elastic restoring force of the slant plate 163 and the branch plates 165 will push the body 140 outward. The barbed structure formed by the cap 156 and the elastic arm 155 is used to be buckled outwardly to the buckle plate 131 on the edge of the first buckle groove 132. The round 158 of the cap 156 will make the cap 156 penetrate through the first buckle groove 132 more smoothly.

A user can open the first cover 111 by pressing the outer lateral portion 154, such that the body 140 will move inwardly and be closer to the second cover 112. At the same time, the cap 156 will also move inwardly, the barbed structure formed by the cap 156 and the elastic arm 155 will be unbuckled to the buckle plate 131, and the cap 156 can be separated from the first buckle groove 132 by pulling the first cover 111 upward. The first cover 111 can be pivoted freely relative to the second cover 112. When the first buckle member 141 and the first buckle joint 122 are buckled together, the slant plate 163 and the branch plates 165 bear against the second cover 112 constantly. Accordingly, the elastic restoring force of the slant plate 163 and the branch plates 165 will push the body 140 outward constantly, such that the cap 156 will not be separated from the first buckle groove 132 even in the case of vibration of the bottle or the false touching on the outer lateral portion 154 by a user. It is ensured that the first buckle member 141 and the first buckle joint 122 will not be separated from each other in an unexpected situation. In an embodiment of the present disclosure, the slant plate 163 is further divided into two branch plates 165, so as to reduce the elastic restoring force, and allow a user to press the outer lateral portion 154 more easily. In another embodiment, the elastic member does not include the separation slot and the branch plates. Instead of providing a whole piece of slant plate directly bear against the second cover, such the elastic member can provide a greater elastic restoring force, and the cap can thus buckle with the first buckle groove more stably, the slant plate 163 as shown in FIG. 6B.

Figure 7:
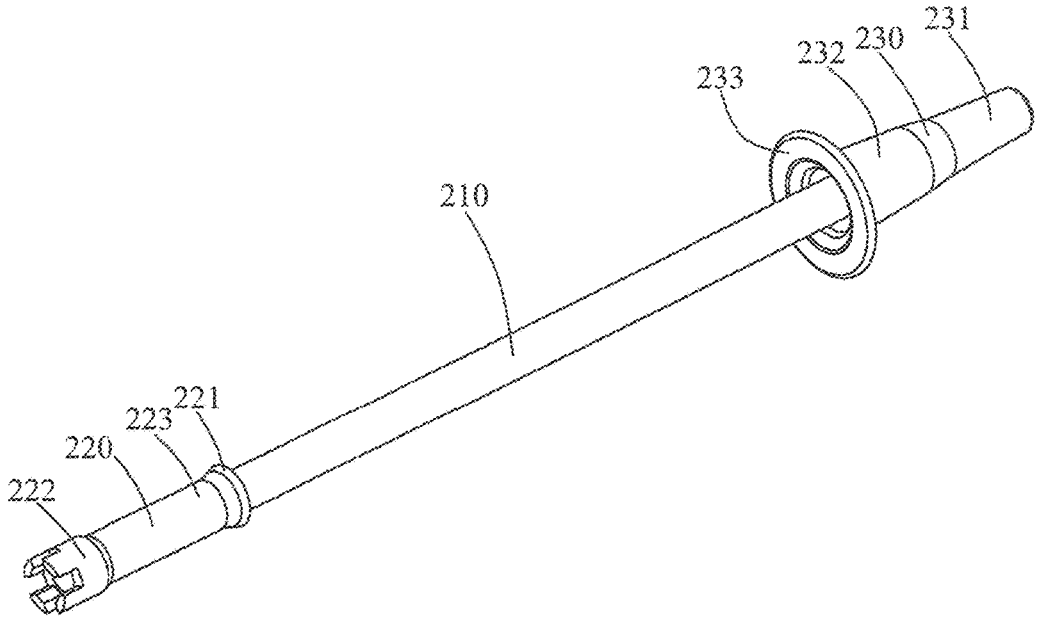
FIG. 7 is a schematic diagram of a straw structure according to an embodiment of the present disclosure.
Figure 8:
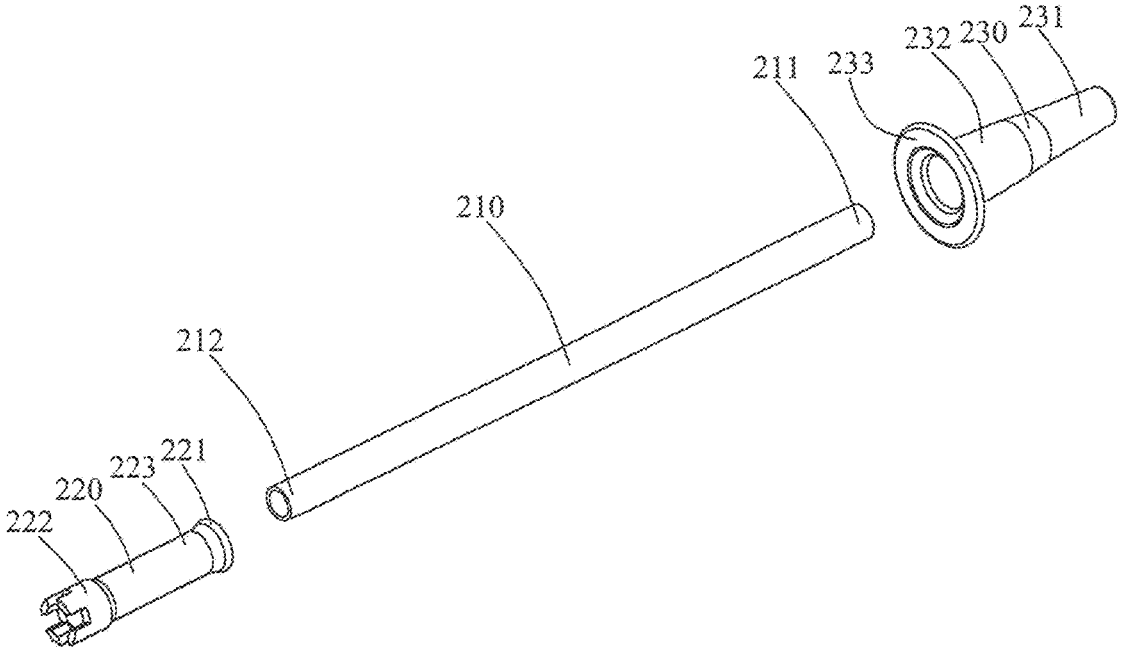
FIG. 8 is an exploded view of the straw structure according to an embodiment of the present disclosure.

Please refer to FIGS. 7 and 8, the straw structure 21 is arranged in the bottle body 30 of the water bottle 1. The straw structure 21 includes an elongate tube 210, an elastic tube 220, and a nozzle tube 230. The elongate tube 210 includes a head end 211 and a tail end 212 opposing the head end 211 (referring to FIG. 8). The elastic tube 220 includes a sleeve joint 221 and a bottom portion 222 opposing the sleeve joint 221, and a neck portion 223.

Figure 9:
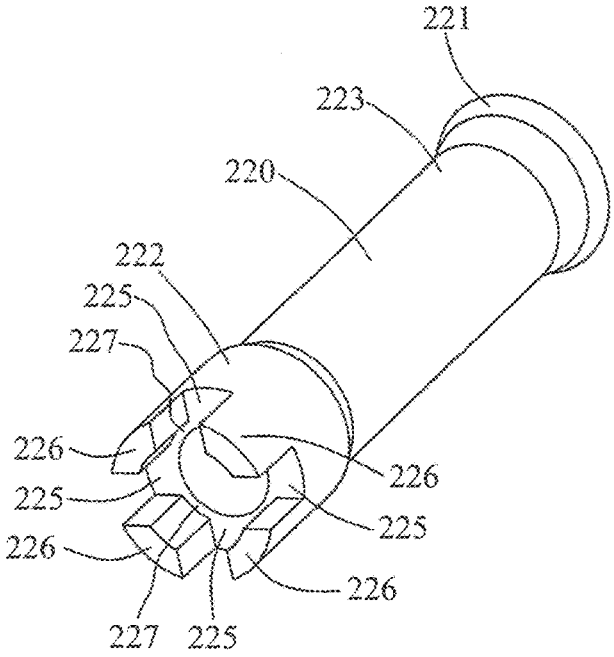
FIG. 9 is a schematic diagram of an elastic tube according to an embodiment of the present disclosure.
Figure 10:
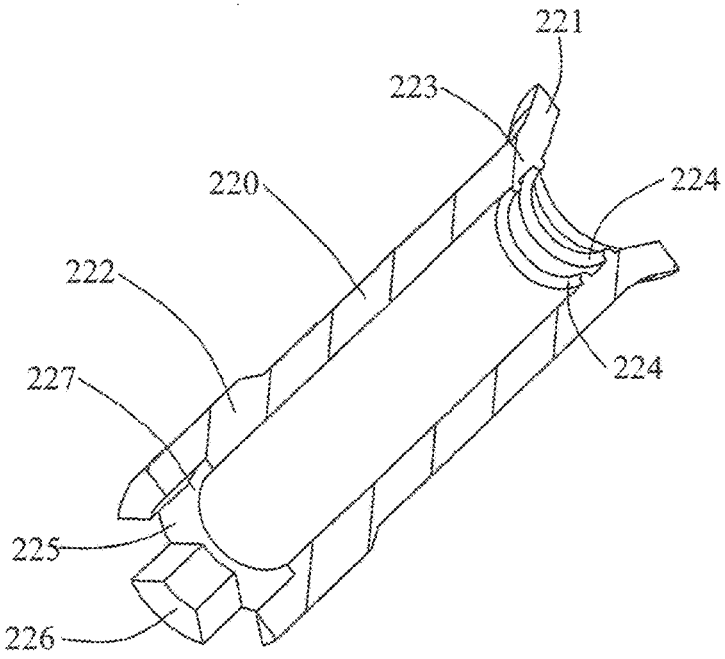
FIG. 10 is a sectional view of the elastic tube according to an embodiment of the present disclosure.

Please refer to FIGS. 9 and 10. The elastic tube 220 is a silicone tube which is mainly made of silicone. The whole body is flexible. The elastic tube 220 is not limited to be made of silicone. The neck portion 223 is adjacent to the sleeve joint 221. The inner wall of the neck portion 223 is provided with at least one annular convex rib 224. In an embodiment, the inner wall of the neck portion 223 is provided with two annular convex ribs 224 which are spaced apart from each other, but not limited thereto. The size of the caliber of the sleeve joint 221 is gradually enlarged in the direction away from the neck portion 223. The shape of the sleeve joint 221 is similar to a horn. In an embodiment of the present disclosure, the opening of the bottom portion of the elastic tube 222 is surrounded by for grooves 225. In another embodiment, the opening is surrounded by more than three grooves, and not limited to four. The four grooves 225 are arranged in a cross structure, and penetrate radially through the tube wall of the bottom of the elastic tube 222. Therefore, the bottom portion of the elastic tube 222 is divided into four arc-shaped columns by the grooves 225, an inner wall of the arc-shaped column becomes thinner outwardly in the radial direction, and a mismatch 227 is formed between the inner wall of the arc-shaped column 226 and the inner wall of the elastic tube 220.

The tail end of the elongate tube 212 can be separately inserted into the sleeve joint 221 and the neck portion 223. The sleeve joint 221 has a horn shape. The size of the caliber near the opening of the sleeve joint 221 is larger than the caliber near the inside of the neck portion 223, for the tail end of the elongate tube 212 to be inserted into the sleeve joint 221 more easily. In an embodiment, the annular convex ribs 224 of the inner wall of the neck portion 223 can be pressed against the tail end of the elongate tube 212 to increase the friction force between the elastic tube 220 and the elongate tube 210, which effectively reduces the possibility of the tail end of the elongate tube 212 separated from the neck portion 223 and the sleeve joint 221.

Figure 11:
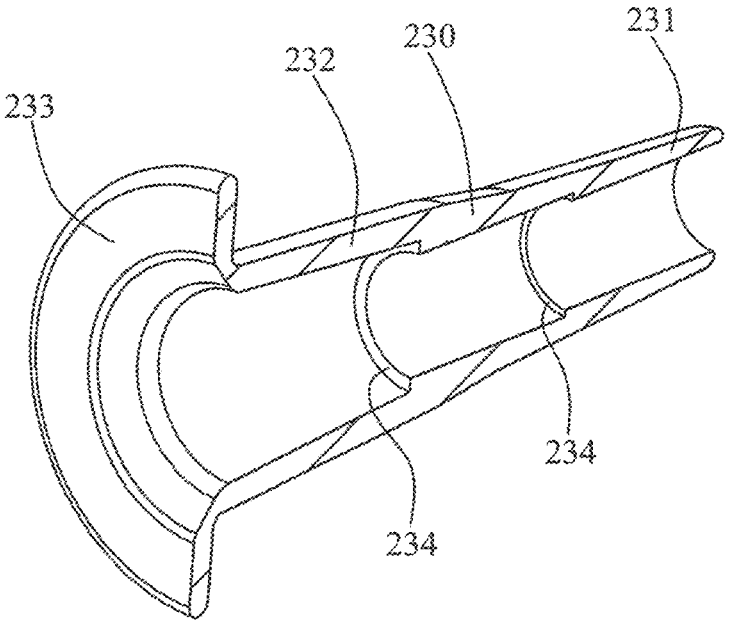
FIG. 11 is a sectional view of a nozzle tube according to an embodiment of the present disclosure.

Please refer to FIG. 11. The nozzle tube 230 includes a head end 231 and a tail end 232 opposing the head end 231. The size of the caliber of the nozzle tube 230 is gradually reduced from the tail end 232 to the head end 231. An annular flange 233 extends outwardly and radially from the tail end 232. The inner wall of the nozzle tube 230 includes an annular step structure 234. The head end of the elongate tube 211 is inserted into the tail end of the straw 232. The annular step structure is helpful to the position and fastening of the head end of the elongate tube 211.

In use, the straw structure 21 can be assembled in the water bottle, the elastic tube 220 is at the bottom of the bottle body 30, the bottom of the elastic tube 222 is pressed in the bottom the bottle body 30, and the nozzle tube 230 penetrates the convex tube 125 of the second cover 112. The straw structure 21 is longer than the water bottle 1, that is, the length from the opening of the convex tube 125 to the bottom of the bottle body 30. Therefore, the head end 231 of the nozzle tube 230 will push out the opening of the convex tube 125 spontaneously, and the annular flange 233 will be pushed around the convex tube 125 under the second cover 112, such that the head end of the straw 231 can be disposed a fixed length for sucking from the bottle body 30 through the head end of the straw 231. When the convex tube 125 is covered with the first cover 111, the down force of the head end of the straw 231 causes the overall structure of the straw 21 moves down, and the elastic tube 220 will bend limited by the bottom the bottle body 30. When the first cover is opened, the elastic restoring force of the flexible elastic tube 220 causes the over structure of the straw 21 moves up, and the head end of the straw 231 will pop up to the outside of the opening of the convex tube 125 automatically, which facilitates the present disclosure very convenient to use. The cross shaped grooves and the arc-column at the bottom of the elastic tube 222 cause the arc-shaped column 226 to be easily spread out by exerting a slightly downward pressure by user, for a user to suck the liquid at the bottom of the bottle body 30 easily.

Therefore, the straw structure according to the present disclosure can be used in a portable water bottle. When a user opens the cover, the straw structure will automatically bounce up and be reset by the elastic restoring force of the elastic tube. Besides, the horn-shaped opening of the sleeve joint is helpful for inserting the elongate tube into the sleeve joint and the neck portion of the elastic tube. The annular convex rib of the neck portion of the elastic tube helps to fix the elongate tube. The cross-shaped grooves and the arc-shaped column at the bottom of the elastic tube can help to suck the liquid remaining at the bottom of the bottle.

In summary, with the first cover, the second cover, the push button structure and the straw structure according to the present disclosure, when the first buckle member is buckled with the first buckle joint, even if the vibration of the bottle or the outer lateral portion of the bottle being mistakenly contacted, the first buckle member and the first buckle joint are not likely to be separated from each other in an unexpected situation because of the design of the elastic restoring force of the elastic member. Besides, the elastic restoring force is provided by the elastic tube of the straw structure of the water bottle, causes the overall structure of the straw would move up after the first cover is opened, and the head end of the straw would pop up out of the opening of the convex tube spontaneously. The water bottle according to the present disclosure has the effects of convenient to use.

While the present disclosure has been particularly shown and described with reference to a preferred embodiment, it will be understood by those skilled in the art that various changes in form and detail may be without departing from the spirit and scope of the present disclosure.

What is claimed is:

1. A water bottle, comprising:

a first cover having a first pivot joint and a first buckle joint;

a second cover having a second pivot joint pivotally connected with the first pivot joint, a second buckle joint, and a hollow convex tube connected with two surfaces of the second cover;

a push button structure configured to connect the first cover with the second cover, the push button structure including:

a body having a top portion, a bottom portion opposing the top portion, and an inner lateral portion disposed between the top portion and the bottom portion;

a first buckle member disposed at the top portion of the body;

a second buckle member disposed at the bottom portion of the body; and an elastic member disposed at the inner lateral portion of the body, wherein the first buckle member is configured to buckle the first cover, the second buckle member is configured to buckle the second cover, and the elastic member is configured to bear against the second cover;

a bottle body connected with the second cover; and a straw structure disposed in the bottle body and the hollow convex tube, the straw structure including:

an elongate tube having opposing first head end and first tail end;

a nozzle tube including opposing second head end and second tail end and a caliber gradually decreased from the second tail end to the second head end, wherein the first head end of the elongate tube is inserted into the second tail end of the nozzle tube; and an elastic tube having a neck portion, a sleeve joint disposed adjacent the neck portion and having a caliber gradually increased in a direction away from the neck portion, and a bottom portion opposing the sleeve joint and having at least three grooves around an opening of the elastic tube, the at least three grooves penetrating a tube wall of the bottom portion of the elastic tube, wherein the first tail end of the elongate tube is detachably inserted into the sleeve joint and the neck portion, wherein the grooves are in a number of four, wherein the bottom portion of the elastic tube is divided by the four grooves into a plurality of arc-shaped columns, each of the arc-shaped columns having an inner wall thinned outwardly in a radial direction, and wherein a mismatch is formed between the inner wall of the arc-shaped column and an inner wall of the elastic tube.

2. The water bottle according to claim 1, wherein the elastic member further includes a slant plate, the slant plate having a free end and a fixed end connected to the inner lateral portion of the body and extending obliquely relative to the body from the fixed end to the free end.

3. The water bottle according to claim 2, wherein the slant plate further includes a separation slot extending in a direction from the free end to the fixed end.

4. The water bottle according to claim 3, wherein the separation slot extends from the free end to a position between the free end and the fixed end, and divides the slant plate into two branch plates.

5. The water bottle according to claim 4, wherein the separation slot has a width gradually decreased from the free end to the fixed end.

6. The water bottle according to claim 2, wherein the elastic member further includes a fillet formed between the slant plate and the body.

7. The water bottle according to claim 1, wherein the first buckle member includes an elastic arm and a cap portion, one end of the elastic arm connected to the top portion and the other end of the elastic arm connected to the cap portion, and wherein the cap portion and the elastic arm form a barbed structure.

8. The water bottle according to claim 7, wherein the first buckle member further includes a chamfer formed between the top portion and the elastic arm, and the cap portion includes a round formed on a side of the cap portion back to the elastic arm.

9. The water bottle according to claim 1, wherein the second buckle member includes two opposing and symmetric feet, each of the feet including an oblique hook disposed at one end of the foot distal to the bottom portion.

10. The water bottle according to claim 1, further comprising at least one annular convex rib provided on an inner wall of the neck portion of the elastic tube and pressed against the first tail end of the elongate tube.

11. The water bottle according to claim 10, wherein the at least one annular convex rib is in a number of two, and the two annular convex ribs are spaced apart from each other.

12. The water bottle according to claim 1, wherein the four grooves are arranged in a shape of a cross.

13. The water bottle according to claim 1, wherein the elastic tube is made of silicone.

14. The water bottle according to claim 1, wherein the second head end of the nozzle tube protrudes from the hollow convex tube, and the second tail end of the nozzle tube has an annular flange extending outwardly in a radial direction.

15. The water bottle according to claim 1, further comprising an annular step structure disposed on an inner wall of the nozzle tube.

16. The water bottle according to claim 1, wherein the second cover further includes at least one handle having a stop portion, and the second pivot joint is located on the handle, and wherein the stop portion is configured to buckle the first cover to the second cover when the first pivot joint of the first cover rotates relative to the second pivot joint.

17. The water bottle according to claim 1, further comprising a sealing pad made of silicone and disposed inside the first cover for sealing the hollow convex tube when the first cover is buckled to the second cover.

* * * * *